US005491841A

United States Patent [19]

Valletta

[11] Patent Number: 5,491,841

[45] Date of Patent: Feb. 20, 1996

[54] CAP WITH SUNGLASSES

[76] Inventor: Robert J. Valletta, 3322 Mount Acadia, San Diego, Calif. 92111

[21] Appl. No.: 206,342

[22] Filed: Mar. 7, 1994

Related U.S. Application Data

[63] Continuation of Ser. No. 80,734, Jun. 22, 1993, abandoned, which is a continuation of Ser. No. 886,783, May 21, 1992, abandoned.

[51] Int. Cl.[6] ..... A42B 1/06

[52] U.S. Cl. ..... 2/10; 2/209.13

[58] Field of Search ..... 2/1, 2, 6.3, 6.5, 2/6.7, 10, 12, 15, 200.1, 209.13, 209.14, 410, 424, 425, 426, 430, 432, 435, 439, 441, 443, 452, 453, 454; 351/166

[56] References Cited

U.S. PATENT DOCUMENTS

| | | | |
|---|---|---|---|
| 352.453 | 11/1886 | Dinner | 2/10 |
| 542,636 | 7/1895 | Goldstein | 2/10 |
| 768,276 | 8/1904 | Fox | 2/10 |
| 889,640 | 6/1908 | Sherman | 2/10 X |
| 899,334 | 9/1908 | Seitzman | 2/10 |
| 1,097,530 | 5/1914 | Cabelinsky | 2/10 X |
| 1,183,385 | 5/1916 | Kunstadter | 2/10 |
| 1,209,284 | 12/1916 | Gazan | 2/10 |
| 1,289,766 | 12/1918 | Hook | 2/10 |
| 1,748,375 | 2/1930 | Wittcoff | 2/10 X |
| 1,781,832 | 11/1930 | Crenshaw | 2/10 |
| 2,425,847 | 8/1947 | Vaca | 2/10 |
| 2,462,258 | 2/1949 | Dannenberg | 2/10 X |
| 3,035,270 | 5/1962 | Boemer | 2/10 |
| 4,101,980 | 7/1978 | Stepan et al. | 2/9 |
| 4,127,697 | 11/1978 | Laurin | 351/166 |
| 4,311,762 | 1/1982 | Spycher et al. | 351/166 |
| 4,319,811 | 3/1982 | Tu et al. | 351/166 |
| 4,547,397 | 10/1985 | Burzynski et al. | 351/166 |
| 4,811,430 | 3/1989 | Janusz | 2/452 |
| 4,839,924 | 6/1989 | Lawrence | 2/10 |
| 4,850,049 | 7/1989 | Landis et al. | 2/10 |
| 4,873,726 | 10/1989 | Tapia | 2/10 X |
| 5,067,174 | 11/1991 | Ritchey et al. | 2/10 |

*Primary Examiner*—Jeanette E. Chapman

[57] ABSTRACT

A cap with an attached flexible film that protects eyes from sunlight. The film, which serves as sunglass lenses, is attached to the base portion at the front of the cap either by stitches or a VELCRO™ fastener. The film can be flipped up inside the cap out of sight when not needed. When the film is in its down position, it can be adjusted for fit by sliding upward or downward as required to conform to height of one's nose bridge.

1 Claim, 1 Drawing Sheet

CAP WITH SUNGLASSES

This is a continuation of U.S. patent application Ser. No. 08/080,734,filed Jun. 22, 1993 now abandoned which is a continuation of prior application Ser. No. 07/886,783 filed May 21, 1992, now abandoned.

BACKGROUND OF THE INVENTION

With ordinary caps, the visor protects one's eyes from the direct sunlight but not from the glare of sunlight. To receive protection from the overall glare of sunlight, sunglasses must also be worn. This can be impractical especially while engaging in vigorous or athletic activity where sunglasses are uncomfortable because they slide down the nose and are also at a risk of breakage. Also, having to bring sunglasses everywhere one goes increases the chances of misplacing them, thus subjecting the owner to their replacement costs.

SUMMARY OF THE INVENTION

The invention of the present disclosure overcomes those common problems by incorporating sunglasses into a cap. Its main feature is to stitch in a flexible film across the front of the cap perpendicular to the visor. The film, which is tinted, serve as sunglass lenses and can be flipped up into the cap when not needed.

Another feature of the invention is the curved design of the film which protects the eyes from sunlight entering from the front and sides. Because the film is suspended from the cap, the film does not have to contact one's nose or ears, thus providing greater comfort. The film can also be adjusted upward or downward to provide an optimum fit.

Additional features include the absence of mechanical parts such as screws, hinges or nose guards so there is never a need to replace lost parts.

There is an option for using different film tints which can be interchanged with the cap by merely attaching the desired film to the cap by a VELCRO™ fastener.

It is an object of the present invention to provide outdoor enthusiasts with a practical means of sunlight protection that is comfortable to wear, easy to use, and convenient to bring along.

So that the manner in which the above recited features, advantages and objects of the present invention are attained and can be understood in detail, a more particular description of the invention, briefly summarized above, may be had by reference to the embodiment thereof which are illustrated in the appended drawings.

It is to be noted, however, that the appended drawings illustrate only typical embodiments of this invention and are, therefore, not to be considered limiting of its scope, for the invention may admit to other equally effective embodiments.

DETAILED DESCRIPTION OF THE PREFERRED EMBODIMENT

Figure 2:
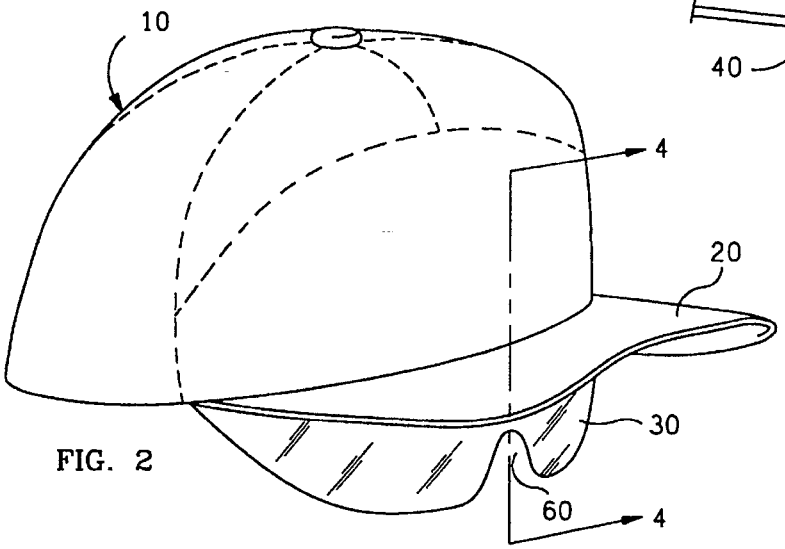
FIG. 2 is a perspective view of the cap with the film flipped down.
Figure 4:
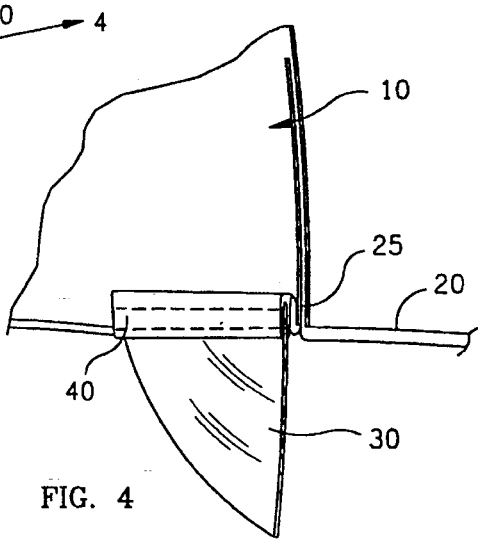
FIG. 4 is a side, cross-sectional view of the cap taken along line 4—4 of FIG. 2.

Attention is first directed to FIG. 2 of the drawing which shows a cap 10 with a flexible film 30 attached to the base 25, FIG. 4, on the front of the cap 10. The cap 10 is of the ordinary variety that has a visor 20 which blocks the suns direct rays from the eyes. The film 30 is positioned under the visor 20 and is curved in a manner which conforms to the arc of the cap 10. There is nose relief 60 in the center that allows the film 30 to fit over the wearer's nose. The curvature of the film 30 allows the eyes to be protected from the sun's glare entering to the front or the periphery of the eyes.

Turning next to FIG. 4 is a drawing which shows the side cross-sectional view of the cap 10 with the film 30 flipped down. The film 30 is approximately perpendicular to the plane of the visor 20. In this illustration, the strip 40 is folded up inside the cap which places the film 30 in its fully upward position.

Figure 5:
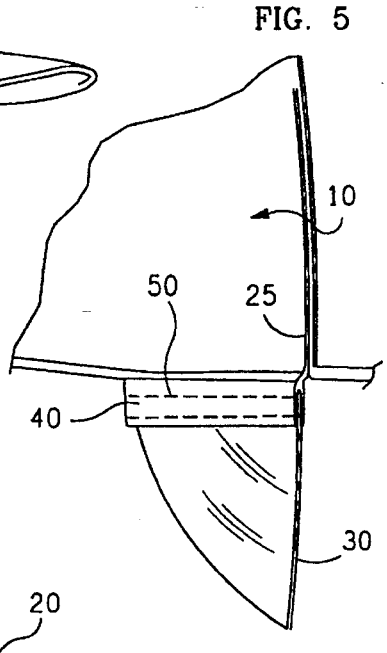
FIG. 5 is a side, cross-sectional view of the cap with the film flipped down and fully extended downward.

FIG. 5 shows the film 30 flipped down and in its fully extended position. This figure illustrates the means by which the film 30 is attached to the cap 10. The film 30 is attached by stitches 50 to the strip 40 and the top of the strip 40 sewn to the inside base 25 of the cap 10. The strip 40 provides the means for adjusting the film 30 upward or downward as the strip 40 is folded upward or extended downward, respectively.

Figure 1:
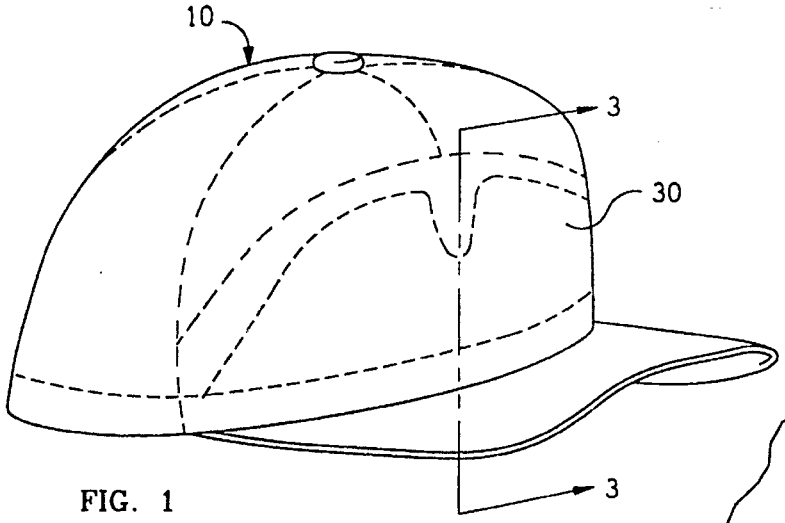
FIG. 1 is a perspective view of the cap with the film flipped up inside the cap.

Referring to FIG. 1, the cap 10 is shown in perspective with the film 30 flipped inside the cap 10. In this arrangement, the film 30 is completely concealed as no portion of the film 30 protrudes beyond the base of the cap 10.

Figure 3:
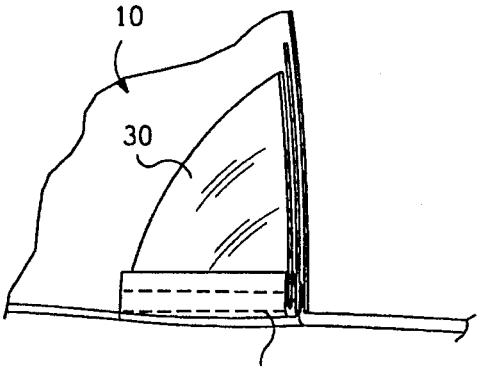
FIG. 3 is a side, cross-sectional view of the cap taken along line 3—3 of FIG. 1.

FIG. 3 shows the side cross-sectional view of the cap 10 with the film 30 flipped up inside the cap 10. The film 30 and strip 40 are completely concealed inside the cap 10.

No metal mechanical parts are used in this invention and all the parts are attached by stitches. In an alternative configuration the film 30 is attached to the cap by a VELCRO™ strip. This allows films of different tints to be used with the cap 10.

In this embodiment, the film 30 is a 0.015 inch polished LEXAN® Graphic Film #8030 that is UV stabilized. The UV stabilization allows the film to block the sun's harmful ultraviolet rays. LEXAN® Graphic Film #8030 is available in thicknesses ranging from 0.007 to 0.030 inch. The optimum thickness for the film used in this application is 0.015 inch because it achieves the best balance between strength, flexibility, and light absorption. If non-UV stabilized film is desired, polished LEXAN® Graphic Film #8020 can be used.

Additionally, along with providing the base attached to the inner peripheral cap edge, the visor connected to and extending from an outer peripheral edge, the flexible strip connected to and extending from the base and the flexible film connected to the flexible strip and having a nose relief, the film and the strip are selectively positioned in a storage position in which the film is flipped fully upward into the cap with the film lying adjacent an inner frontal edge of said cap, in a lower in-use position with said flexible strip having a straight cross-section, and in an upper in-use position with the flexible strip folded into an "S"-shaped cross-section adjacent said base band.

While the foregoing is directed to the preferred embodiment of the present invention, other and further embodiments of the invention may be devised without departing from the basic scope thereof, and the scope thereof is determined by the claims which follow.

What is claimed is:

1. In a cap which conforms to a forehead of a person and includes a base attached to an inner peripheral edge of said cap, and a visor connected to and extending perpendicular from an outer peripheral edge of said cap for blocking sunlight, a method of wearing said cap comprising the steps of:

providing a flexible strip connected to and extending from said base;

providing a flexible transparent film having a flat top edge connected to said flexible strip and a nose relief; and selectively positioning said film and said flexible strip in a storage position in which said film is flipped fully upward into said cap with said film lying adjacent an inner frontal edge of said cap, in a lower in-use position with said flexible strip having a straight cross-section, and in an upper in-use position with said flexible strip folded into an "S"-shaped cross-section adjacent said base band.

* * * * *